United States Patent [19]

Bartley

[11] Patent Number: 4,840,360

[45] Date of Patent: Jun. 20, 1989

[54] EXPANDING MANDREL

[75] Inventor: Donald L. Bartley, Willoughby, Ohio

[73] Assignee: Kennametal Inc., Latrobe, Pa.

[21] Appl. No.: 183,943

[22] Filed: Apr. 20, 1988

[51] Int. Cl.[4] ..... B21D 41/02

[52] U.S. Cl. ..... 269/48.1

[58] Field of Search ..... 411/76; 403/297; 242/72 R, 72 B; 65/272; 228/44.5, 45; 279/2 R; 269/48.1, 234, 47

[56] References Cited

U.S. PATENT DOCUMENTS

| | | | |
|---|---|---|---|
| 670,468 | 3/1901 | Collins | 279/2 R |
| 1,683,167 | 9/1928 | Cunningham . | |
| 2,790,246 | 4/1957 | May | 279/2 R |
| 3,117,483 | 1/1964 | Brown . | |
| 3,833,229 | 9/1974 | Hohwart et al. . | |
| 3,986,383 | 10/1976 | Petteys | 269/48.1 |
| 4,464,076 | 8/1984 | Leibhard . | |

*Primary Examiner*—Robert C. Watson

*Attorney, Agent, or Firm*—Thomas R. Trempus

[57] ABSTRACT

An expanding mandrel is disclosed for operation within a cylindrical sleeve, which may be rotated within the sleeve while engaging the workpiece. A three point contact is made within the inner diameter of the workpiece utilizing only a two piece device. A body member is provided having a working end which engages an inner diameter of a workpiece at a single point. A single wedge member which is generally elliptical in cross section slidably engages the body member. The wedge has a working end which engages the inner diameter of the workpiece at two points, the wedge being biased by a spring within the body member. In operation, the wedge and body member are forced against the inner diameter of the workpiece by the spring, and are released by the application of external pressure on an internal shaft to permit the application and removal of the mandrel from a workpiece.

18 Claims, 1 Drawing Sheet

EXPANDING MANDREL

FIELD OF THE INVENTION

The present invention relates to a device for grasping and retaining the inner diameter of a tubular workpiece. More specifically, the present invention relates to a mandrel which fits entirely within a cylindrical sleeve during operation, and engages the inner diameter of the workpiece at three points.

BACKGROUND ART

A number of mandrel and expanding dowel devices have been previously disclosed. The prior art has several drawbacks which are exemplified in those patents disclosed below.

The stability of the grasp of the mandrel, and the accuracy of the location of the device within the inner diameter of a workpiece is directly related to the number of contact points between the two elements. Most of the prior art mandrels disclose only two point contact. For example, they have two circular or parabolic elements which are slidably engaged in a wedge configuration which come into contact with the inner diameter of the workpiece at the apex of each of the semi-circular mandrel elements. This type of configuration is exemplified by Cunningham, U.S. Pat. No. 1,683,167; Brown, U.S. Pat. No. 3,117,483; and the first embodiment of Liebhard, U.S. Pat. No. 4,464,076.

Another problem encountered in prior art mandrels is the method of actuation. Some, like Cunningham, have external handles or actuation mechanisms which present a problem if space is a consideration. These methods of actuation also may prevent rotational motion about a central axis if the workpiece must be spun while within the grasp of the mandrel. Hohwart, et. al, U.S. Pat. No. 3,833,229, exemplifies a mandrel which cannot be rotated even without an external activation mechanism.

Lastly, the number of moving pieces to obtain the maximum number of contact points is important. A smaller number of moving pieces reduces the error of misaligned mandrel elements, while a greater number of contact points increases the accuracy of centering the mandrel within the workpiece. While Hohwart, et. al., U.S. Pat. No. 3,833,229, utilizes a three-point contact, it is accomplished by four elements, a base and three moving wedges. Liebhard, U.S. Pat. No. 4,464,076, discloses a three point contact having three moving elements in the second embodiment shown.

DISCLOSURE OF THE INVENTION

An expanding mandrel is disclosed which is particularly adapted for operation entirely within a cylindrical sleeve. The mandrel utilizes three contact points with the workpiece, but accomplishes this with only two moving parts.

A body member is inserted into the workpiece which has an end adapted to engage the inner diameter of the workpiece at a single point. A spring or other resilient means is mounted within the body member which is then attached to a single wedge member slidably engaging the body member. The wedge also has an end which is inserted into the workpiece, but engages the inner diameter at two points. The wedge is attached to the spring or resilient means so that it is biased towards engagement with the inner wall of the workpiece.

A shaft is inserted into the end of the body member opposite the working end for compressing the spring and sliding the wedge towards the working end of the body member. This decreases the diameter of the mandrel and allows insertion into the workpiece. When the external pressure is released, the wedge and body member are forced against the inner diameter of the workpiece by the resilient means, forming a three point contact.

These and other advantages and features of the present invention will be more fully understood on reference to the presently preferred embodiments thereof and to the appended drawings.

BEST MODE OF PRACTICE OF THE INVENTION

I disclose an expanding mandrel for operation within a cylindrical sleeve, which may be rotated within the sleeve while engaging the workpiece. The mandrel comprises a body member preferably having a concave inner surface and a generally parabolic cross-sectional outer surface. The body member has a working end which engages an inner diameter of a workpiece at a single point. Within the body member is a cylindrical bore adapted to contain a resilient means. The resilient means is preferably a spring.

A single wedge member which is generally elliptical in cross section slidably engages the body member. The wedge has a working end which engages the inner diameter of the workpiece at two points, the wedge being biased by the resilient means in a direction opposite the working end of the body member. The wedge and resilient means are connected by a dowel passing through a hole in the inner surface of the body member sized and shaped to permit the passage of the dowel.

Shaft means are provided for compressing the resilient means and sliding the wedge towards the working end of the body member. The shaft means is preferably a rod and a plunger having on end abutting the rod and another end engaging the resilient means, wherein the rod conveys an external force to the plunger which compresses the resilient means.

In operation, the wedge and body member are forced against the inner diameter of the workpiece by the resilient means, forming a three point contact, and are released by the application of external pressure on the shaft means to permit the application and removal of the mandrel from a workpiece.

Figure 1:
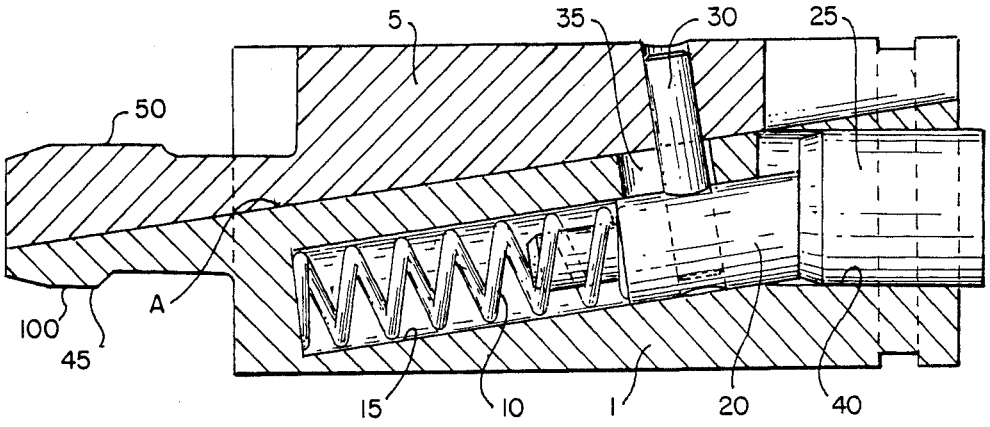
FIG. 1 is a side elevation in cross section of the invention.

Referring to FIG. 1, the mandrel is shown having a body member 1 which contains a canted cylindrical bore 15 adapted to contain resilient means 10, which is preferably a spring. The body member 1 also has a rod bore 40 which extends from the rear end of the body member to meet the canted bore 15 at an interior point.

The resilient means 10 engages a plunger 20 within canted bore 15. A rod 25 is slidingly inserted into rod bore 40, which engages the plunger 20. Rod 25 and plunger 20 combine to form a shaft means by which external force is exerted on the resilient means 10.

Wedge 5 is slidably engaged to body member 1 along a curved surface A which is concave on body member 1 and convex on wedge 5. The wedge has a dowel rod 30 extending outwardly therefrom which passes through a slotted hole 35 in the surface A of the body member 1. The dowel 30 is affixed to plunger 20, and is adapted to slide wedge 5 with the movement of plunger 20 and rod 25 against resilient means 10.

Figure 2:
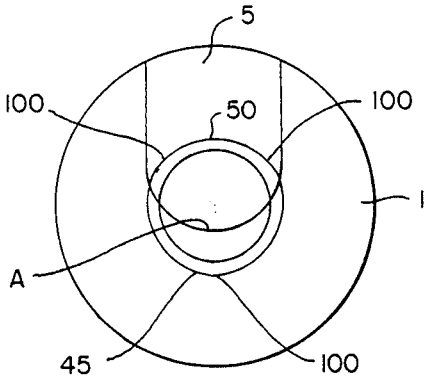
FIG. 2 is a front elevational view of the invention.

Referring to FIG. 2, the body member 1 is shown having a generally parabolic outer surface 45 and a concave engaging surface A. The wedge 5 is shown having a generally elliptical surface 50. Approximate points of contact 100 are shown on the two members. The actual placement of the points of contact on wedge 5 is controlled by varing the oblate character of the ellipsoid shape.

In operation, the rod 25 is pushed inwardly by an external force (not shown), which forces plunger 20 against resilient means 10. The plunger moves downwardly through canted bore 15, while wedge 5 moves in a parallel manner along surface A, joined to plunger 20 by dowel 30. This reduces the diameter of the working end of the mandrel and allows the insertion of the working end into a cylindrical workpiece. The pressure on rod 25 is then released, and the resilient means 15 expands, forcing plunger 20, dowel 30 and wedge 5 upwardly along the canted bore 15, slot 35 and surface A, respectively. The wedge 5 and body member 1 come into contact with the workpiece at points of contact 100. The mandrel is held in place by the force of resilient mean 10.

Due to the cylindrical nature of the entire mechanism, this device is suited for use entirely contained within a cylindrical sleeve. It may be extended or retracted by outside force as necessary. In addition, due to the self contained nature of the device, and the symmetry of rod bore 40 and rod 25, the entire mandrel or the workpiece may be rotated freely within the encompassing cylindrical sleeve.

While I have described a present preferred embodiment of the invention, it is to be distinctly understood that the invention is not limited thereto but may be otherwise embodied and practiced within the scope of the following claims.

I claim:

1. An expanding mandrel for operation within a cylindrical sleeve comprising:

(a) a body member having a concave inner surface and having a working end which engages an inner diameter of a workpiece at a single point;

(b) resilient means mounted within the body member;

(c) a single wedge member slidably engaging the body member concave inner surface having a working end which engages the inner diameter of the workpiece at two points, the wedge engaging and being biased by the resilient means in a direction opposite the working end of the body member;

(d) shaft means for compressing the resilient means and sliding the wedge towards the working end of the body member;

wherein the wedge and body member are forced against the inner diameter of the workpiece by the resilient means, forming a three point contact, and are released by the application of external pressure on the shaft means.

2. An expanding mandrel as described in claim 1, wherein the body member has a generally parabolic cross-sectional outer surface.

3. An expanding mandrel as described in claim 1, wherein the wedge and resilient means are connected by a dowel.

4. An expanding mandrel as described in claim 3, wherein the body member has a hole in the inner surface sized and shaped to permit the passage of the dowel connecting the resilient means and the wedge.

5. An expanding mandrel as described in claim 1, wherein the resilient means is a spring.

6. An expanding mandrel as described in claim 1, wherein the body member has a cylindrical bore adapted to contain the resilient means.

7. An expanding mandrel as described in claim 1, wherein the wedge member is generally elliptical in cross section.

8. An expanding mandrel as described in claim 1, wherein the shaft means further comprises a rod and a plunger having one end abutting the rod and another end engaging the resilient means, wherein the rod conveys an external force to the plunger which compresses the resilient means.

9. An expanding mandrel as described in claim 1, wherein the entire device may be rotated within the cylindrical sleeve while engaging the workpiece.

10. An expanding mandrel for operation within a cylindrical sleeve comprising:

(a) a body member having a working end which engages an inner diameter of a workpiece at a single point;

(b) resilient means mounted within the body member;

(c) a single wedge member slidably engaging the body member having a working end which engages the inner diameter of the workpiece at two points, the wedge being connected to and the resilient means by a dowel and being biased by the resilient means in a direction opposite the working end of the body member;

(d) shaft means for compressing the resilient means and sliding the wedge towards the working end of the body member;

wherein the wedge and body member are forced against the inner diameter of the workpiece by the resilient means, forming a three point contact, and are released by the application of external pressure on the shaft means.

11. An expanding mandrel as described in claim 10, wherein the body member has a generally parabolic cross-sectional outer surface.

12. An expanding mandrel as described in claim 10, wherein the body member has a hole in the inner surface sized and shaped to permit the passage of the dowel connecting the resilient means and the wedge.

13. An expanding mandrel as described in claim 10, wherein the resilient means is a spring.

14. An expanding mandrel as described in claim 10, wherein the body member has a cylindrical bore adapted to contain the resilient means.

15. An expanding mandrel as described in claim 10, wherein the wedge member is generally elliptical in cross section.

16. An expanding mandrel as described in claim 10, wherein the shaft means further comprises a rod and a plunger having one end abutting the rod and another end engaging the resilient means, wherein the rod conveys an external force to the plunger which compresses the resilient means.

17. An expanding mandrel as described in claim 10, wherein the entire device may be rotated within the cylindrical sleeve while engaging the workpiece.

18. An expanding mandrel for operation within a cylindrical sleeve comprising:

(a) a body member having a working end which engages an inner diameter of a workpiece at a single point;

(b) resilient means mounted within the body member;

(c) a single wedge member slidably engaging the body member having a working end which engages the inner diameter of the workpiece at two points, the wedge engaging and being biased by the resilient means in a direction opposite the working end of the body member;

(d) shaft means for compressing the resilient means and sliding the wedge towards the working end of the body member, the shaft means further comprising a rod and a plunger having one end abutting the rod and another end engaging the resilient means, wherein the rod conveys an external force to the plunger which compresses the resilient means;

wherein the wedge and body member are forced against the inner diameter of the workpiece by the resilient means, forming a three point contact, and are released by the application of external pressure on the shaft means.

* * * * *